US005653139A

United States Patent [19]

Lee

[11] Patent Number: 5,653,139

[45] Date of Patent: Aug. 5, 1997

[54] PORTABLE REBAR BENDING DEVICE AND METHOD

[75] Inventor: Jimmy Dale Lee, Buena Park, Calif.

[73] Assignee: Pacific Benders, Inc., Buena Park, Calif.

[21] Appl. No.: 444,204

[22] Filed: May 18, 1995

[51] Int. Cl.[6] ..... B21D 7/02

[52] U.S. Cl. ..... 72/217; 72/219

[58] Field of Search ..... 72/217, 218, 219, 72/216

[56] References Cited

U.S. PATENT DOCUMENTS 3,861,186 1/1975 Wigner, Jr. ..... 72/217

4,167,865 9/1979 Powell ..... 72/217

*Primary Examiner*—Lowell A. Larson

*Assistant Examiner*—Rodney Butler

*Attorney, Agent, or Firm*—Morland C. Fischer

[57] ABSTRACT

A portable pneumatic rebar bending device has a base portion, a pivoting portion, and a pneumatic cylinder connecting and operable to pivot the pivoting portion with respect to the base portion. The axis of pivot includes a radiused wheel having a shallow "V" shaped slot about which the radius of curvature of the rebar is formed. The radiused wheel can be, where necessary, removed from the pivoting members where the required bend is so extreme that the device would otherwise be trapped. A pair of handles facilitates manual positioning and carriage. A weak spring acts to reset the pivoting member with respect to the base member once the pneumatically operated cylinder is de-pressured. The weak spring prevents injury on closure, since the presence of a hand or finger is more that adequate to prevent the force of the spring from acting to close the two members. An adjustment is provided to enable a variety of sizes of rebar to be used with the device of the present invention.

19 Claims, 4 Drawing Sheets

PORTABLE REBAR BENDING DEVICE AND METHOD

FIELD OF THE INVENTION

The present invention relates to the field of construction equipment. More specifically, the present invention relates to a hydraulically operated, portable system for efficient and structurally sound bending of reinforcing steel emanating from a surface or not yet placed in surface with minimum effort and maximum safety for the user.

BACKGROUND OF THE INVENTION

In construction, reinforcing steel may be supplied in a variety of different forms. Typically the reinforcing steel is known as rebar and is available in a variety of diameters and textures. The most common texture is that of a double helical raised spiral surface, which forms a pair of opposite spiral patterns as viewed from one end of the rebar to the other. The raised spiral surfaces enable the rebar to engage the concrete commonly known as deformed bar or rebar. In instances where the rebar may be either built together or inserted into cement, the rebar extends straight up from the cement surface of the freshly dried concrete.

The necessity for not pre-bending the rebar must not be overlooked. Even where the rebar is pre-bent for the purpose of forming advantageous shapes to reinforce the concrete, the ends will need to be left straight until after pouring, since the level of the concrete may vary depending on the accuracy of the pour. The shape and extent of the rebar which exists after the concrete form is made is important to the structural integrity of the other concrete forms which will be combined with the rebar which is to be bent for proper clearance.

Further, the structural integrity of the exposed rebar itself can be critical to the further structures which are formed with and integral to the rebar which is bent. Where the rebar is attempted to be bent without further aid, a corner bend is made at the surface of the cement. This is especially harmful, and can virtually eliminate the usefulness of the exposed rebar. In the best case, the rebar can simply break off. At least a complete failure will form an overt indication that there is no rebar to use. A complete failure may cause the complete re-pouring of the structure, but at least it will not lead to the reliance on the damaged structure and therefore result in a later failure and possible loss of lives.

Other methods may involve the manual bending of the rebar around an object placed adjacent the area of the rebar extending into the concrete. The problems with this method are many. In some cases the object will move causing the bulk of the bending moment to occur at the concrete surface, with only a gently sloping bending applied to the remainder of the rebar. In this case, the construction inspector may be fooled into believing that the rebar is properly bent, when in fact the structural damage done is equivalent to that for a straight angle bend.

Further, the size of the rebar can cause a different result for different objects. The radius of the bend needs to be related to the size of the rebar. A one inch diameter rebar should not be bent about a one half inch radius, and conversely, a one quarter inch rebar should not be bent about a 10 inch radius. The bend is also meant to terminate the rebar, such that tensile force parallel to the rebar as it extends from the concrete will not wholly be translated into an axial force with respect to the rebar which extends from the concrete. A sharper bend is associated with the creation of force against the bend, whereas a shallow bend enables the rebar to exert more of an axial pulling force in the concrete into which it is placed.

It is for these reasons that a gentle and well placed bend is so important to enable the resulting structure to maximally take advantage of the full strength available in the rebar, as well as the holding force of the rebar which extends parallel to and along the surface of the concrete from which it extends. One result of the need for well placement is the need to have an even radiused bend occur at varying heights above the surface of the concrete. Where an object is used to assist the bending of the rebar, it will usually not have the stability to enable the bend to occur at various heights. Where the person bending the rebar is using force about an object, the object must be of the correct radius and have an adequate height.

Such an object would be prohibitive to be placed between extending lengths of rebar particularly where the spacing is narrow, such as between about one foot and about six inches. Further, workers may not be expected to physically transport such a device, and may require the help of a crane. Even where a structure for rebar bending is employed, the construction worker must still effect the bending. Typically this is done with mechanical advantage by the use of a pipe placed over the end of the rebar, combined with tugging and pulling on the pipe. Even where a properly diameter structure is present, such haphazard bending is problematic, for a number of reasons.

First, the bend may still not be proper. Second, the time for physical manipulation is prohibitive. Third, the bending may "trap" the device or die about which the rebar is bent. The time consumed for a single worker to bend each rebar set, which is prohibitive, will be even worse if manual bending results in a trap of the structure. A trapped structure can cause the worker to have to bend the bar back to free the structure. Bending the rebar both ways significantly weakens the rebar.

What is therefore needed, in the construction field, is a device and method for enabling the quick, safe, easy and sure bending of rebar. The needed device should have a number of characteristics which give it utilitarian advantages on the job. The characteristics should include the inability of the device to become "trapped". The bending should be able to be achieved at varying heights above the level of the concrete surface. The bending should always produce an even radius of curvature. The bending should be automatic to eliminate the energy expenditure by the construction worker. The device used for bending should be portable and as light weight as possible to facilitate its use between closely set rebar and also at elevations significantly above ground level.

SUMMARY OF THE INVENTION

The portable pneumatic rebar bending device and method of the present invention includes a hinged device having a base portion, a pivoting portion, and a pneumatic cylinder connecting and operable to pivot the pivoting portion with respect to the base portion. The axis of pivot includes a radiused wheel having a shallow "V" shaped slot about which the radius of curvature of the rebar is formed. The radiused wheel can be, where necessary, removed from the pivoting members where the required bend is so extreme that the device would otherwise be trapped.

A pair of handles facilitates manual positioning and carriage. A weak spring acts to reset the pivoting member with respect to the base member once the pneumatically operated cylinder is de-pressured. The weak spring prevents injury on closure, since the presence of a hand or finger is more that adequate to prevent the force of the spring from acting to close the two members.

An adjustment is provided to enable the bender to accept different sizes of rebar to get a true 90° bend. An operator judgment or control can be used for a bend of less than 90°. The device of the present invention can simply be elevated against any appropriate support to cause a perfectly radiused bend to occur anywhere along the length of a piece of rebar. Thus, once a suitable support is selected to achieve a height of bend, the same support can be carried along with the device of the present invention, and placed atop the concrete at each rebar location to achieve the same bend at the same height. The support can be as simple as a simple length of planking or a two-by-four, and thus is easily transported along with the device of the present invention.

The device of the present invention is constructed so that the cylinder will not touch or scratch any other surface on the device nor any part of the rebar being bent. In this manner, the device is virtually fool proof and will not need operator intervention for proper operation, once the angle of bend is set. The device of the present invention is constructed of steel plate and uses commonly available hardware in order that construction costs and fabrication are kept to a minimum.

A lower spacer wheel is cam mounted and can, be adjusted to the different size of rebar to give a true 90° radius bend. The present invention can be constructed in a variety of sizes for different types and strengths of rebar.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
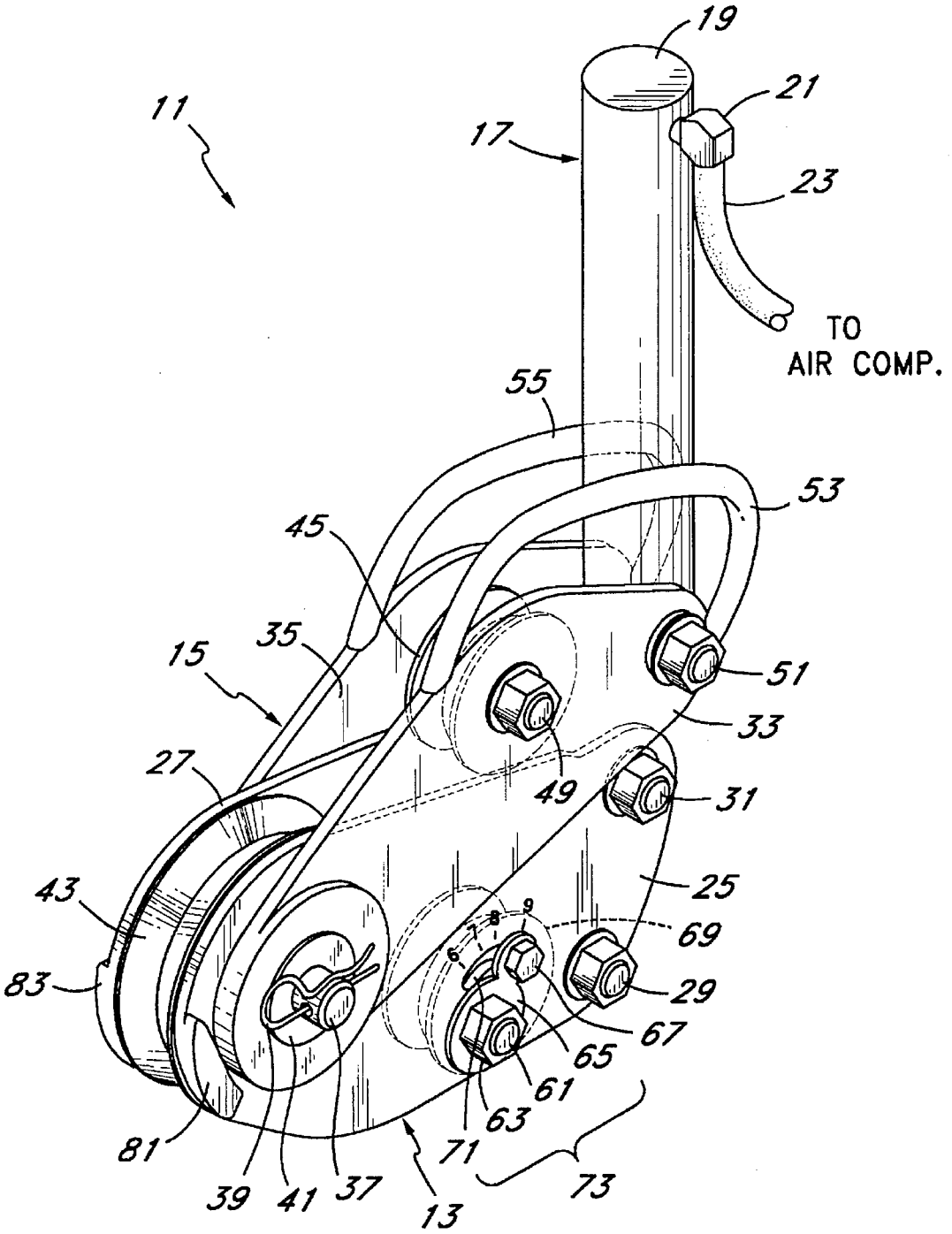
FIG. 1 is a perspective view of the portable pneumatic rebar bending device shown partially in phantom to point out the extent of the two side plates which are pivotable with respect to each other.

The description and operation of the invention will be best described with reference to FIG. 1. The perspective view of FIG. 1 illustrates one configuration of a portable pneumatic rebar bending device 11, which includes a base portion 13 and an upper pivoting portion 15. Connected between the base portion 13 and an upper pivoting portion 15, is a pneumatic/hydraulic cylinder assembly 17 which includes a piston actuation housing 19 and a piston (not yet shown). The pneumatic/hydraulic cylinder assembly 17 can operate with fluid power from a hydraulic fluid source. The piston actuation housing 19 has a fitting 21 which is connected to a hose 23.

The base portion 13 has a first plate 25 attached to a second plate 27 largely by a pair of rear bolts 29 and 31, secured by their respective nuts. The upper pivoting portion 15 has a pair of plates, namely first plate 33 and second plate 35 both of which lie parallel to and outside plates 25 and 27, respectively.

At the front of the device 11, the first and second base plates 25 and 27 are pivotally attached to the first and second pivoting plates. At the point of pivot, an axle 37 is secured by a cotter pin 39 which rides against a washer 41. The axle 37 rotatably supports a bending radius wheel 43 which has a gently and shallow shaped "V" radial cross section. The bending radius wheel 43 can be replaced with larger or smaller sized wheels, to give different radiused bends or to reverse bend to straighten presently bent rebar. Such straightening may especially occur neglecting the spacing requirements of the other wheels (to be discussed.)

Axle 37 can be taken out to remove wheel 43 in case of entrapment or to change size of wheel 43. Doing so, the upper plates 33 & 35 still remain connect to lower plates 25 & 27.

The wheel 43 is rotatable even though it is expected that very little rotation will occur during the rebar bending process. An upper pivoting portion wheel 45 is shown predominantly in phantom as being rotatably connected between plates 33 and 35, and secured by a bearing bar 49 and its associated nuts. The upper pivoting portion wheel 45 also has a gently "V" shaped radial cross sectional configuration to engage the rebar to be bent. In practice, wheel 45 is expected to rotate during the bending operation.

Upper pivoting portion wheel 45 acts as a bearing surface, or bearing wheel, to both produce bending as well as having the ability to roll over the surface being bent. This gives advantages, including the non-frictional contact with the material being bent.

A bolt end or threaded member 51 is also shown as attached to its nut, and secures a sleeve (to be shown) which is further secured to the piston actuation housing 19. This allows the piston actuation housing 19 to pivot with respect to the upper pivoting portion 15, especially when the upper pivoting portion 15 is pivoting with respect to the base portion 13. The piston end extending from the piston actuation housing 19 is attached to the base portion 13 and by bolt 31.

Note how the bolt 31 and its nut engages the bottom edge of plate 33, effectively providing a stop to further downward pivoting of the upper pivoting portion 15 with respect to the base portion 13. Since the closure force is very weak, the point of contact will not be a stressful one.

Note also the presence of a pair of upper handles 53 and 55. Handle 53 is attached to plate 33, while handle 55 is attached to plate 35. Having the pair of handles facilitates manual carriage from either side, and also facilitates two-handed manual positioning over the length of rebar to be bent.

Also shown near the bottom of the base portion 13 on the plate 25 is an adjustment setting. A bolt 61, which is engaged by a nut 63, secures a linking plate 65 to the side of the plate 25. The linking plate 65 is also engaged by a smaller bolt 67. The end periphery of the smaller end of the linking plate 65 is adjacent a scale, and opposing what is shown as the numeral "9". The other numerals shown include "8", "7", and "6". These numbers are approximations for sizes of rebar.

Both of the bolts 67 and 61 engage a base wheel 69 which is shown in phantom. The bolt 61 provides the pivot point for the base wheel 69 and does not engage base wheel 69 through it center. Thus, the base wheel 69 is not rotatable about its center, and in fact, the rotation of base wheel 69 is limited to the pivoting of the linking plate 65. Note that bolt 67 engages a slot 71 in the plate 25.

It is understood that base wheel 69 serves as an anchoring structure against which other portions of the rebar or steel rod is to be bent. The structure 69 is the adjusting wheel for different sizes of rebar to keep the true 90° bend. Alternatively, the structure 69 could be formed of a member having a vertically flat portion to spread the force applied to a vertical member along a vertically more elongated length. The anchoring structure, in the form of base wheel 69 can be larger or smaller than that shown, and can provide for a greater or smaller range of size of rebar that is shown in the Figures.

When bolt 67 is loosened, and assuming the nut 63 of bolt 61 is loose enough for adequate play, the base wheel 69 is pivoted as the bolt 67 slides throughout the extent of slot 71. The position of the base wheel 69 can be fixed by tightening nut 63 and by tightening bolt 67. Fixing the base wheel 69 also fixes the extent of bending which will occur for a given size of rebar. In initially bending the first rebar, the adjustment group 73, made up of the nut and bolt combination 61 and 63, linking plate 65, bolt 67 and slot 71, can be adjusted to approach the best bend.

Of course, a pointer could extend from the end of the link plate 65 to more accurately indicate the rebar sizes shown on the side of the device 11 for a really fine adjustment, but since a change in rebar size will cause a significantly wide resulting variation, the added radial accuracy of base wheel 69 position from an expanded scale would probably not result in any actual gains in being able to measure the resulting bend.

The Ram was designed to fit the body in the full extended position to obtain a true 90° bend on specified sizes of rebar wheel 69. Also seen in FIG. 1 are two optional projections from the base plates 25 and 27. A first stop 81 projects from the surface of plate 25 and will act to stop the extent of pivotal travel of the plate 33 with respect to the base plate 25. A second stop 83 projects from the surface of plate 27, and is only partially seen in FIG. 1, and will act to stop the extent of pivotal travel of the plate 35 with respect to the base plate 27. The symmetrical positions of the stops 81 and 83 are identical, causing an even stopping force to be applied to the upper pivoting portion 15 from the stopping forces applied to each of the upper plates 33 and 35.

Of course the stops 81 and 83 are optional, and will not be shown on subsequent Figures, especially since a variety of other mechanical structures, in indeed the device 11 can be made to stop by virtue of having reached the extent with which cylinder assembly 17 has extended itself.

Figure 2:
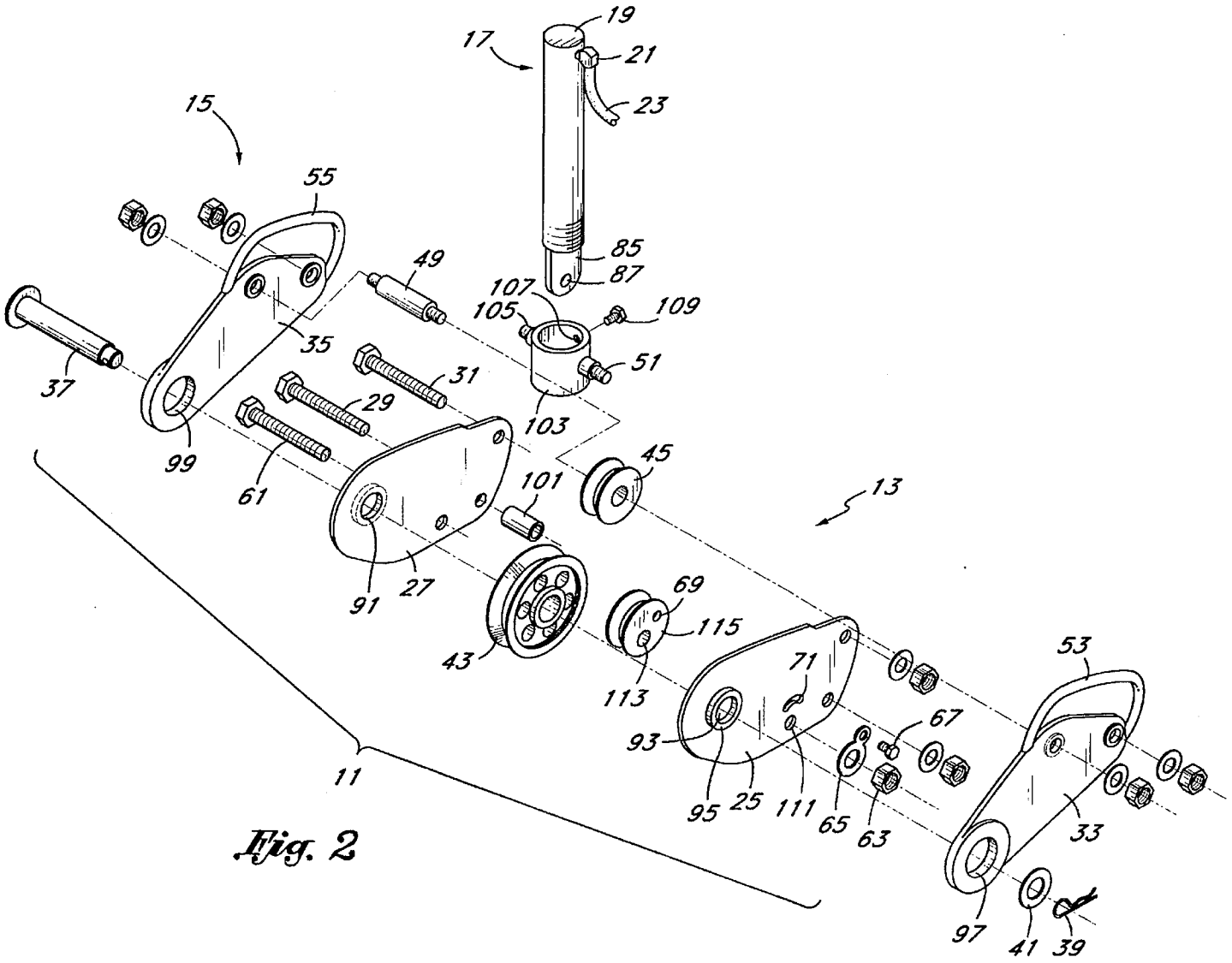
FIG. 2 is an exploded view of the illustrating the component parts thereof which contribute to simplicity of construction and operation.

Referring to FIG. 2, many features not previously seen in the view of FIG. 1 are now visible. From the top of FIG. 2, at the pneumatic/hydraulic cylinder assembly 17, the end of a piston cylinder 85 is seen as having an aperture 87. The aperture 87 will engage the bolt 31 when the bolt 31 is secured.

Also absent from the exploded view of FIG. 2 are the stops 81 and 83 which were shown in FIG. 1. This emphasizes their optional nature and illustrates that other structures can be used to limit the degree of travel. One of the best ways is to select a cylinder assembly 17 which is incapable of opening the device 11 to such an extent that the cylinder 85 will touch another object.

The base plate 27 has a main aperture 91 and having a boss shown in phantom. The base plate 25 has an aperture 93 surrounded by an outwardly directed boss 95, which is symmetrical with the boss of main aperture 91. The outwardly directed boss 95 engages the internal area of aperture 97 of the upper plate 33. Base plate 27 has aperture 99 which similarly engages a boss shown in phantom extending outwardly from base plate 27.

The base plate 27 is also seen as having a deep spacer or boss 101 which prevents the pressure from the bolt 29 from binding the wheel 69 placed in between the plates 27 and 25. As was previously seen, the threaded member 51 is attached to a sleeve 103. Sleeve 103 also has a threaded member 105 oppositely oriented with respect to the threaded member 51 for engagement with a nut on the other side of upper pivoting plate 35. The sleeve 103 thus acts as a spacer for the purpose of limiting the closeness of the upper pivoting plates 33 and 35. Cylinder assembly 17 has threads at its lower end, just above where the piston 85 is shown extending downwardly.

Sleeve 105 has an internally threaded portion which engages the threads on the lower end of cylinder assembly 17, and further contains small threaded aperture 107 extending laterally into the sleeve 103. The small threaded aperture 107 is engaged by a bolt 109 to lock the assembly 17 into its threaded engagement with the sleeve 105.

As can also be seen, an aperture 111 underlies the slot 71 and to accommodate the bolt 61. Other apertures, washers, and nuts are present for securing the bolts and are not numbered or further discussed for clarity. However, note the wheel 69 and its bores. A larger smooth bore 113 extends completely through the wheel 69 and accommodates the bolt 61. The wheel 69 will rotate about the axis of bolt 61. A threaded bore 115 is provided for engagement with the bolt 67, and does not extend completely through the wheel 69. Thus, bolt 67 can, when tightened into wheel 69, lock the wheel 69 against the side of the plate 25, and fix the position of the wheel 69 about the axis of the bolt 61.

Figure 3:
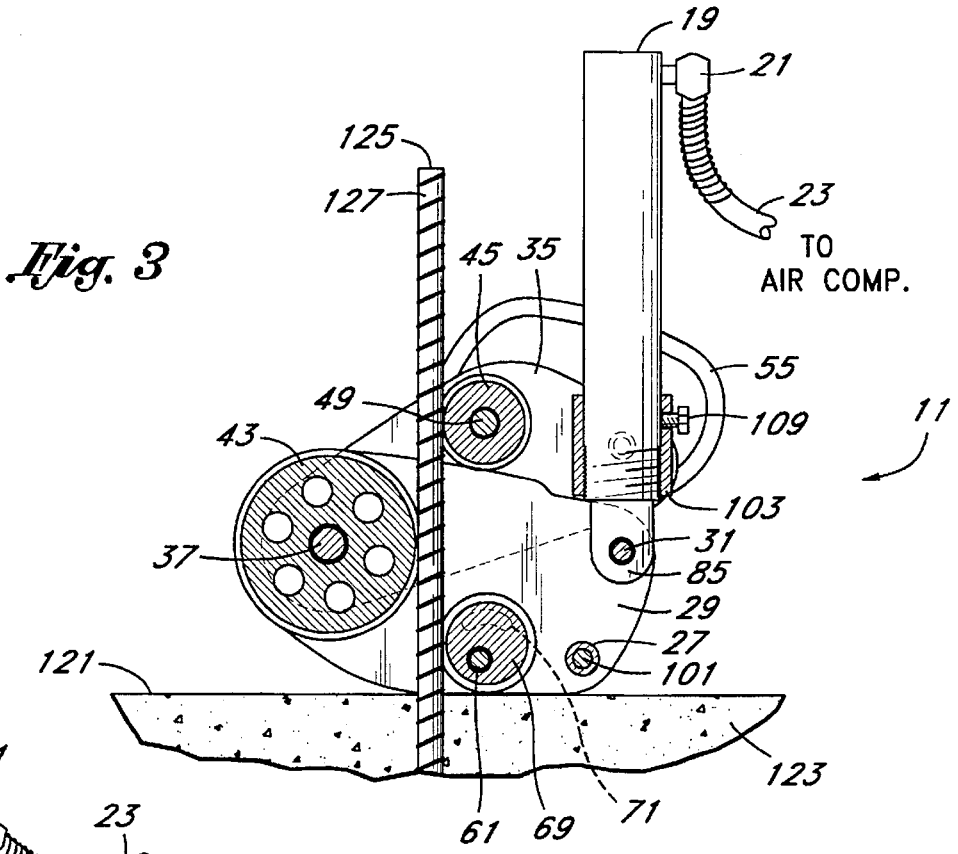
FIG. 3 is a sectional view of the portable pneumatic rebar bending device shown in FIGS. 1 and 2 as it is positioned for actuation atop a concrete surface and surrounding a length of rebar and illustrates the position immediately before actuation.

Referring to FIG. 3, a side sectional view of the device 11 is positioned onto a flat surface 121 of concrete 123. Extending upwardly through the concrete 123 and above the flat surface 121 is a length of rebar 125. Rebar 125 has a single spiral raised land 127 to assist it in engaging the concrete 123 as well as any other concrete which will be poured around it after it is bent.

In FIG. 3, please note that the three wheels, namely upper pivoting portion wheel 45, base wheel 69, and bending radius wheel 43, are closely fitting about the length of the rebar 125. This is the form for a 90° bend. For lesser bends, there will be more play between the rebar 125 and either the wheel 43 or the wheels 45 and 69. As can be seen, a full pivot of the device 11 would produce a lesser bend where there is additional space between the rebar 125 and the wheels 43 and 45 or 69.

Figure 4:
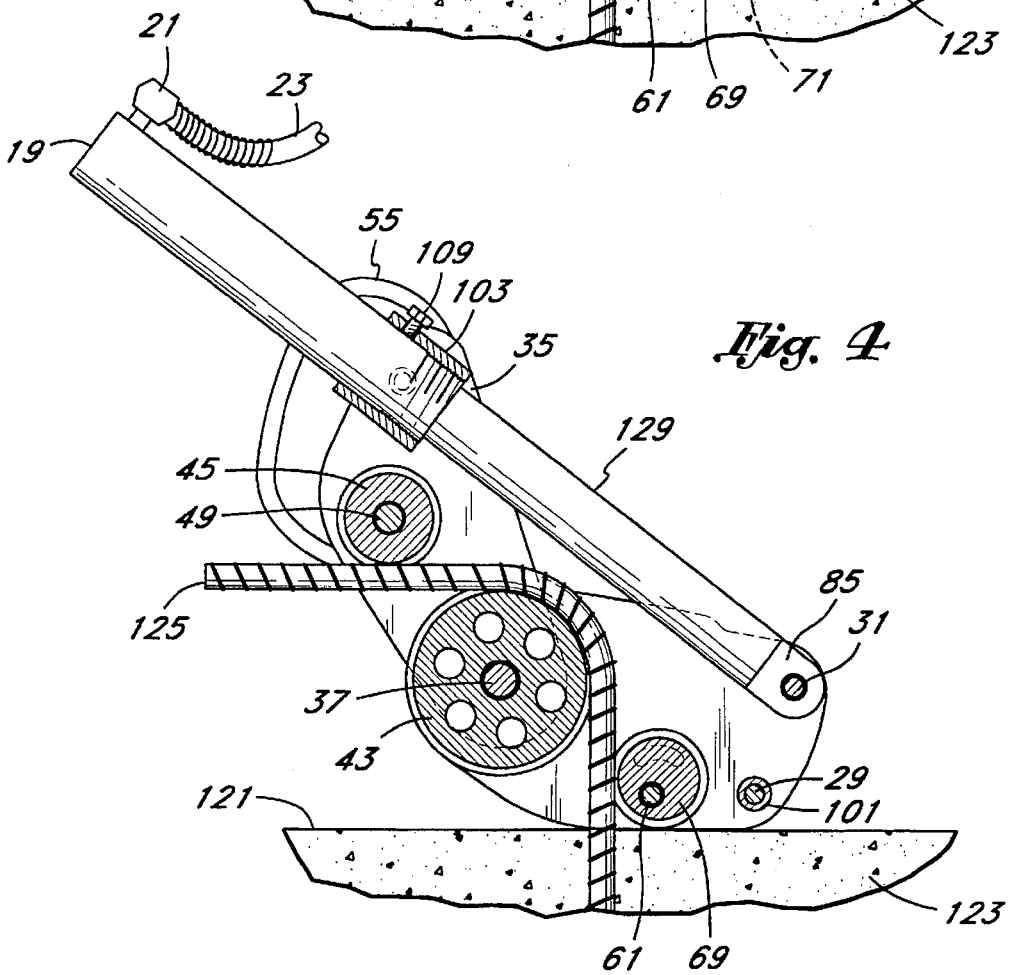
FIG. 4 is a sectional view of the portable pneumatic rebar bending device as shown in FIGS. 3 as it is positioned after having effected a 90° bend in a length of rebar and where the radius of bend is shown to begin perhaps several inches above a concrete surface.

Referring to FIG. 4, the device 11 is shown in its fully pivoted open position. The piston surface 129 is exposed, and is seen for the first time. Note that the piston rod 85 has good clearance with respect to the rebar 125, regardless of the diameter size of the rebar 125. The rebar 125 now has an evenly radiused bend, with the upper end of the rebar 125 extending at an angle of 90° with respect to the length of extension of the rebar 125 extending out of the concrete 123.

Several noteworthy observations may be made here. First, the device 11 does not, aside from its own weight, bear upon the concrete in making the bend. The rebar 125 contact points, which are neither too far from nor too close to the middle of the bend, are used to apply the force to make the bend. Second, the surface 129 of the piston 85 does not come close to contacting the rebar 125 at the mid point of its bend. This feature is very important, as any contact with the surface 129 would not only score the surface and degrade the performance of the pneumatic/hydraulic cylinder assembly 17, but can further bend the piston 85. Third, the running of the piston 85 out of the assembly 17 to its full length again and again will not produce excess stresses and destructive forces in the device 11.

A return spring device (not shown) may be present within the pneumatic/hydraulic cylinder assembly 17 and which will gently recapture the piston 85 and draw it back into the piston actuation housing 19 when pressure is no longer applied. The pneumatic/hydraulic cylinder assembly 17 is capable of being used with any fluid, but is preferably powered by a hydraulic pump.

In the operation of the device 11, the operator simply fits the device 11 over the rebar 125 as is shown in FIG. 3. It is fitted such that the rebar extends between the wheel 43 on one side and both wheels 45 and 69 on the other side. A switch or some other actuation device is then triggered to introduce pressure through hose 23 and into the piston housing 19 to force the piston 85 out ward to cause the upper pivoting portion 15 to pivot open with respect to the base portion 13, to thereby cause the wheel 45 to urge the rebar 125 over the wheel 43, while wheel 69 holds the rebar 125 steady with respect to the wheel 43.

Once the piston 85 is completely run out of the piston housing 19, for the setting applied to the adjustment group 73, the operator causes pressure supplied to hose 23 to reduce to enable the re-entry of the piston 85 into the piston housing 19.

Where a device 11 is enabled to make bends approximating or greater than 90°, and where the end of the rebar 125 is lower than the bend, as can be visualized in FIG. 4, the device 11 is then "trapped". To free the device 11, and referring back to FIG. 1, the cotter pin 39 is removed and the axle 37 is easily removed, thus freeing the wheel 43 which drops to the ground. The device 11 can be then lifted up, wheel 43 can be re-acquired from the ground, and the device can be re-assembled as in FIG. 1. When the axle 37 is removed, the base portion 13 does not become separated from the upper pivoting portion 15.

As can be seen in FIG. 2, the outwardly directed boss 95 still engages the aperture 97 of the plate, and since the plates 25 and 27 are still rigidly joined, and since the plates 35 and 33 are still rigidly joined, this causes the base portion 13 to not become separated from the upper pivoting portion 15. As such the removal of the axle 37, which causes removal of the wheel 43, will have no other effect than simply the removal of the wheel 43.

The device 11, when re-assembled can then be brought down about another length of rebar 125 and the bending process repeated. Alternatively, the device 11 can be brought around a length of rebar 125 without re-insertion of the wheel, and then have the wheel re-inserted only after the device 11 is in place with respect to the rebar 125. This can be especially useful for bending objects which have an obstruction at the tip end, and may not be limited only to rebar or bar steel, but may include pipes and other round objects.

Figure 5:
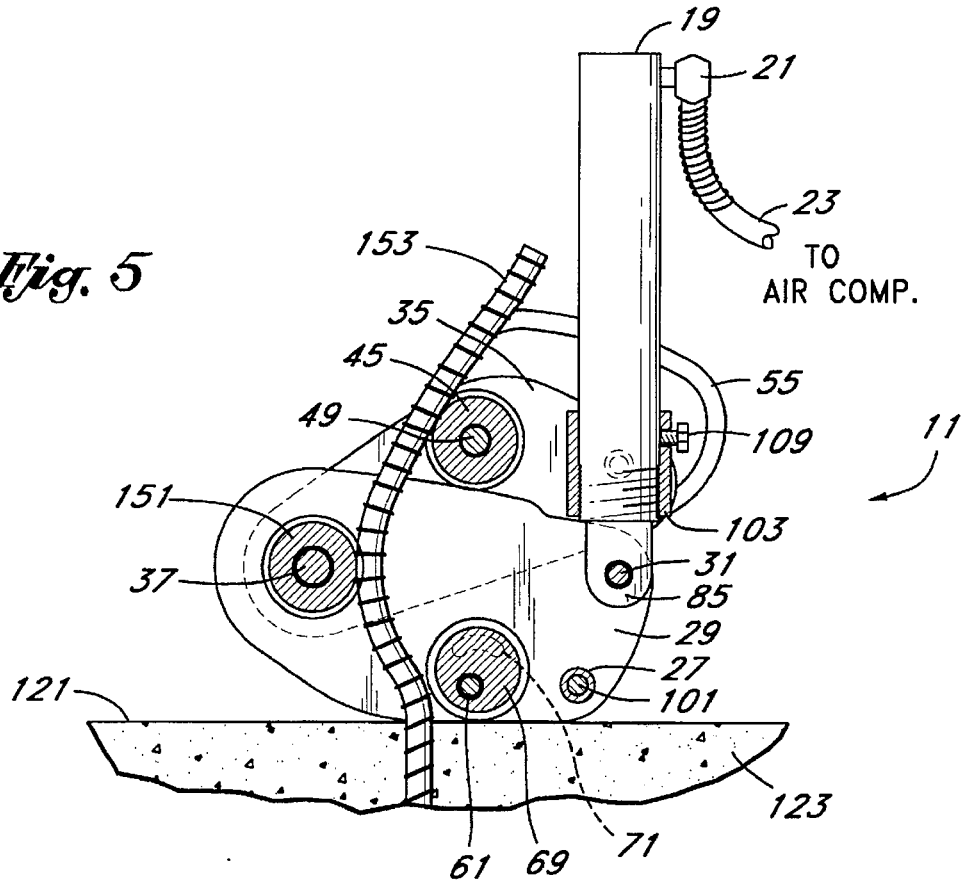
FIG. 5 is a sectional view of the portable pneumatic rebar bending device shown in FIGS. 1–4 as it is positioned for actuation atop a concrete surface and surrounding a length of rebar which is bent and which is to be straightened, as it is in position immediately before actuation.
Figure 6:
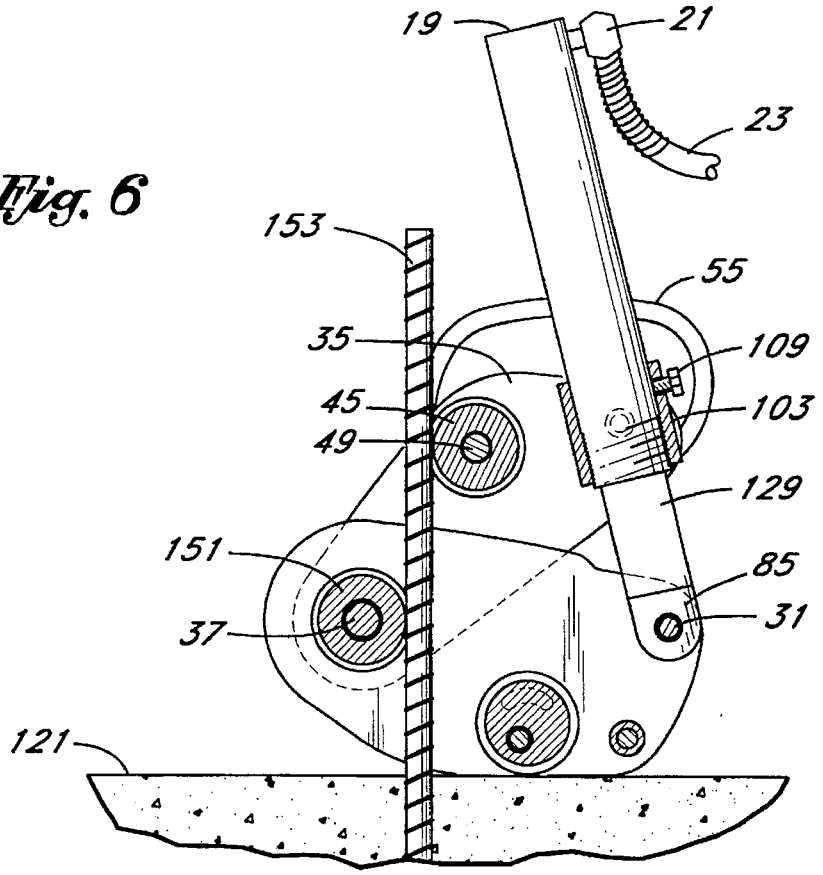
FIG. 6 is a sectional view of the portable pneumatic rebar bending device as shown in FIG. 5 as it is positioned after having effected a straightening in a length of rebar.

Referring to FIG. 5, the device 11 is shown as being fitted with a smaller bending radius wheel 151, in lieu of the bending radius wheel 43. The smaller radius of the wheel 151 enables the device 11 to be positioned to straighten out a piece of bend rebar 153, as is shown in FIG. 5. The view of FIG. 6 illustrates the now straightened rebar 153 is achieved. In straightening rebar 153, the device 11 may be actuated several times to achieve a straightened length of rebar 153 as is shown in FIG. 6.

For example, the length of rebar 153 of FIG. 5 is shown as having a sharp bend nearer the surface 121 of the concrete 123, and more gently bending as it extends upwardly away from the surface 123. Further, the rebar 153 may be bent in several dimensions. As can be seen in FIG. 6, the wheel 69 may or may not be in a position against the rebar 153 as the final bends in the rebar 153 is accomplished. The fine bend of FIG. 6 shows the device 11 sitting flat against the surface 121, such that the friction between the device 11 and the surface 121 is used as the third point of force reference, along with the wheels 151 and 45 to finally straighten the rebar 153.

While the present invention has been described in terms of a portable pneumatic rebar bending device, one skilled in the art will realize that the structure and techniques of the present invention can be applied to many appliances. The present invention may be applied in any situation where a controlled and shape specific form is to be impressed onto a length of material.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A bending device comprising:

a base portion carrying an anchoring structure to prevent movement of said base portion and a bend formation structure attached to said base portion and spaced apart from said anchoring structure to accommodate a length of material to be bent thereover;

an upper pivoting portion pivotally attached to said base portion independent of said bend formation structure to enable said bend formation structure to be removed without detaching said upper pivoting portion from said base portion, said upper pivoting portion being pivotable to a limited extent with respect to said base portion and having a bearing surface for engaging the length of material to be bent over said bend formation structure; and actuation means connected to said base portion and to said upper pivoting portion for forcibly pivoting said upper pivoting portion relative to said base portion and towards said bend formation structure.

2. The bending device recited in claim 1 wherein said bend formation structure further comprises:

a wheel; and an axle for securing only said wheel to said base portion.

3. A bending device comprising:

a base portion carrying an anchoring structure to prevent movement of said base portion and a bend formation structure attached to said base portion and spaced apart from said anchoring structure, and wherein said anchoring structure is round and has a bore offset form its radial center and is adapted to be pre-positionably turned around said bore to a position closer to or farther from said bend formation structure in order to accommodate a length of material to be bent over said bend formation structure;

an upper pivoting portion pivotally attached to said base portion and pivotable to a limited extent with respect to said base portion and having a bearing surface for engaging the length of material to be bent over said bend formation structure; and actuation means connected to said base portion and to said upper pivoting portion for forcibly pivoting said upper pivoting portion relative to said base portion and towards said bend formation structure.

4. The bending device of claim 1 wherein said actuation means for forcibly pivoting said pivoting portion away from said base portion is a pneumatic/hydraulic cylinder assembly which further comprises:

a piston actuation housing connected to said pivoting portion and having a fluid inlet; and a piston cylinder portion, slidably actuatable from said piston actuation housing and connected to said base portion.

5. The bending device system of claim 1 wherein said base portion further comprises:

a first base plate;

a second base plate spaced apart from and generally parallel to said first base plate;

a bending radius wheel having an axis perpendicular to said first and second base plates and having a surface against which an object to be bent is to be shaped;

an anchoring wheel having an axis perpendicular to said first and second base plates and having a surface against which an object to be bent is to anchored during the bending process; and wherein said pivoting portion further comprises:

a first pivot plate;

a second pivot plate spaced apart from and generally parallel to said first pivot plate, said first and second pivot plates pivotally attached to said first and second base plates and lying outside said first and second base plates;

a bearing wheel having an axis perpendicular to said first and second pivot plates and having a surface which will bear against an object to be bent as such object to be bent is urged around said bending radius wheel; and means for attaching said first pivot plate to said second pivot plate and means for attaching said first base plate to said second base plate.

6. The bending device recited in claim 2 wherein said axle is in the shape of a pin having an enlarged first end, and a second end having a bore transverse to the axis of said axle and further comprising a pin engaged into said bore to hold said axle in place with respect to said base portion.

7. The bending device of claim 2 wherein said wheel has a radially outwardly disposed concave surface.

8. The bending device recited in claim 3 wherein said anchoring structure is adjustable to enable said bending device to produce a range of angles of bend in a material of from about 95° to about 50°.

9. A bending device system as recited in claim 3 wherein said anchoring structure contains a threaded bore and wherein said base portion contains a slot extending radially with respect to said axis of said smooth bore of said anchoring structure; and further comprising an anchoring bolt extending through said slot of said base portion and engaging said threaded bore of said anchoring structure.

10. The bending device of claim 4 wherein said piston actuation housing and said piston cylinder portion are carried essentially vertically when said upper pivoting portion is not pivoted away from said base portion.

11. The bending device recited in claim 5 wherein said actuation means for forcibly pivoting said pivoting portion away from said base portion is a pneumatic/hydraulic cylinder assembly and further comprising:

a cylindrical sleeve having an internal surface and an external surface and located between said first pivot plate and said second pivot plate and pivotally mounted with respect to said upper pivoting portion, and securing one end of said pneumatic/hydraulic cylinder assembly, the other end of said pneumatic/hydraulic cylinder assembly supported by said base portion.

12. The bending device system as recited in claim 5 and further comprising a first handle attached to said first pivot plate and a second handle attached to said second pivot plate.

13. The bending device recited in claim 11 where the position of said pneumatic/hydraulic cylinder assembly within said cylindrical sleeve is fixably adjustable.

14. The bending device of claim 11 wherein the other end of said pneumatic/hydraulic cylinder assembly is connected to said means for attaching said first base plate to said second base plate.

15. A bending device system as recited in claim 9 wherein said means for attaching said first pivot plate to said second pivot plate and means for attaching said first base plate to said second base plate further comprise bolts extending through apertures in said first and second pivot plates and said first and second base plates and secured by nuts, and wherein at least one of said bolts extends through said smooth bore of said anchoring structure is engaged by at least one of said bolts; and further comprising a linking plate secured by said at least one of said bolts and by said anchoring bolt, a position of said linking plate forming an indication of the magnitude of bend to be produced by said bending device.

16. A process of bending reinforcing rods comprising the steps of:

placing a bending device having a base structure and a pivoting structure in engagement with a reinforcing rod such that a bend formation structure of said base portion is positioned adjacent said reinforcing rod and such that an anchoring structure of said base portion and a bearing structure of said pivoting structure are positioned oppositely with respect to said reinforcing rod;

actuating a force engine to cause said pivoting structure to pivot away from said base structure to cause said bearing structure to move towards and bend said reinforcing rod against said bend formation structure;

de-actuating said force engine to cause said pivoting structure to pivot back toward said base structure and said bearing structure to move away from said reinforcing rod;

after de-actuating said force engine, removing said bend formation structure from said bending device to free said bending device from said reinforcing rod; and re-assembling said bend formation structure into said bending device after said reinforcing rod has been freed.

17. The process of bending reinforcing rods as recited in claim 16 and further comprising the step of adjusting the position of said anchoring structure of said base portion with respect to said bend formation structure, to pre-select the degree of bend achievable upon full actuation of said pivoting portion with respect to said base portion, and before actuating said force engine step.

18. The process of bending reinforcing rods as recited in claim 14 wherein said removing said bend formation structure from said bending device is accomplished by the steps of:

removing a cotter pin from an axle securing said bend formation structure to said bending device;

removing said axle from said bend formation structure and said bending device; and allowing said bend formation structure to fall away from said bending device; and wherein said re-assembling said bend formation structure into said bending device further comprises the steps of:

re-positioning said bend formation structure with respect to said bending device;

re-inserting said axle into said bend formation structure and said bending device; and re-inserting said cotter pin into said axle to secure said axle to said bending device to thereby secure said bend formation structure to said bending device.

19. The process of bending reinforcing rods as recited in claim 16 wherein said actuating a force engine step is accomplished to bend said reinforcing rod into a substantially straight orientation.

* * * * *